US011952186B2

(12) United States Patent
Geiger et al.

(10) Patent No.: US 11,952,186 B2
(45) Date of Patent: Apr. 9, 2024

(54) PAWL-LATCHING DEVICES

(71) Applicant: HellermannTyton Corporation, Milwaukee, WI (US)

(72) Inventors: Gerard G. Geiger, Jackson, WI (US); Scott J. Adams, Menomonee Falls, WI (US)

(73) Assignee: HellermannTyton Corporation, Milwaukee, WI (US)

( * ) Notice: Subject to any disclaimer, the term of this patent is extended or adjusted under 35 U.S.C. 154(b) by 0 days.

(21) Appl. No.: 18/350,443

(22) Filed: Jul. 11, 2023

(65) Prior Publication Data

US 2023/0348159 A1 Nov. 2, 2023

Related U.S. Application Data

(62) Division of application No. 17/659,767, filed on Apr. 19, 2022, now Pat. No. 11,738,922.

(60) Provisional application No. 63/257,047, filed on Oct. 18, 2021, provisional application No. 63/214,142, filed on Jun. 23, 2021, provisional application No. 63/213,606, filed on Jun. 22, 2021.

(51) Int. Cl.
*B65D 63/10* (2006.01)

(52) U.S. Cl.
CPC .... *B65D 63/1072* (2013.01); *B65D 2563/103* (2013.01); *B65D 2563/107* (2013.01)

(58) Field of Classification Search
CPC ..... B65D 63/1072; B65D 2563/103; B65D 2563/107; B65D 63/1027
See application file for complete search history.

(56) References Cited

U.S. PATENT DOCUMENTS

| | | | | |
|---|---|---|---|---|
| 3,258,819 | A | 7/1966 | Weckesser | |
| 3,537,146 | A | 11/1970 | Caveney | |
| 3,872,547 | A * | 3/1975 | Caveney | F16L 3/2334 24/16 PB |
| 3,900,922 | A | 8/1975 | Mccormick | |
| 3,908,233 | A * | 9/1975 | Caveney | F16L 3/2334 24/16 PB |

(Continued)

FOREIGN PATENT DOCUMENTS

| | | |
|---|---|---|
| CH | 544523 | 1/1974 |
| CN | 1623861 | 6/2005 |

(Continued)

OTHER PUBLICATIONS

"Extended European Search Report", EP Application No. 22195180.9, Jan. 30, 2023, 7 pages.

(Continued)

*Primary Examiner* — David M Upchurch
(74) *Attorney, Agent, or Firm* — Colby Nipper PLLC

(57) ABSTRACT

Techniques and apparatuses directed to improved pawl-latching devices are described in this document. The disclosed techniques and apparatuses provide pawl-latching devices with pawls structured to avoid the sinking and warping problems present in some conventional injection molding processes. In aspects, the pawl-latching devices include a pawl having at least one of a pivot member including a notch, a release feature on the pawl spaced apart from the front and sides of the pawl, a recess defined in the top of the pawl, and/or a recess defined in the bottom of the pawl.

20 Claims, 9 Drawing Sheets

(56) References Cited

U.S. PATENT DOCUMENTS

| | | | | |
|---|---|---|---|---|
| 3,965,538 | A * | 6/1976 | Caveney | B65D 63/1072 24/16 PB |
| 4,009,509 | A | 3/1977 | Mccormick | |
| 4,269,379 | A | 5/1981 | Mccormick | |
| 4,413,380 | A | 11/1983 | Suzuki | |
| 4,490,887 | A | 1/1985 | Sarton et al. | |
| 4,557,023 | A | 12/1985 | Six et al. | |
| 4,735,387 | A | 4/1988 | Hirano et al. | |
| 4,805,856 | A | 2/1989 | Nicoli et al. | |
| 5,193,250 | A | 3/1993 | Caveney | |
| 5,267,373 | A | 12/1993 | Chisek | |
| 5,386,615 | A | 2/1995 | Bernard | |
| 5,669,253 | A | 9/1997 | Higgins | |
| 5,759,004 | A | 6/1998 | Kuffel | |
| 5,966,781 | A | 10/1999 | Geiger | |
| 6,347,435 | B1 | 2/2002 | Davignon et al. | |
| 6,530,126 | B2 | 3/2003 | Caveney | |
| 6,533,226 | B2 | 3/2003 | Geiger | |
| 6,898,825 | B1 | 5/2005 | Charest | |
| 7,143,480 | B2 | 12/2006 | Igarashi | |
| 7,278,188 | B2 | 10/2007 | Kurmis | |
| 7,661,633 | B2 | 2/2010 | Igarashi et al. | |
| 8,281,461 | B2 | 10/2012 | Geiger | |
| 11,027,902 | B2 * | 6/2021 | Geiger | B65D 63/1072 |
| 11,097,879 | B1 * | 8/2021 | Chen | B65D 63/1072 |
| 11,738,922 | B2 | 8/2023 | Geiger et al. | |
| 2002/0084388 | A1 | 7/2002 | Geiger | |
| 2007/0023586 | A1 | 2/2007 | Geiger | |
| 2007/0175001 | A1 | 8/2007 | Tomory et al. | |
| 2007/0251062 | A1 | 11/2007 | Saitoh et al. | |
| 2008/0250609 | A1 | 10/2008 | Franks | |
| 2010/0306967 | A1 | 12/2010 | Geiger | |
| 2014/0013552 | A1 | 1/2014 | Liang et al. | |
| 2015/0321814 | A1 | 11/2015 | Rodrigues Pereira | |
| 2018/0080580 | A1 | 3/2018 | Coukter | |
| 2019/0248521 | A1 | 8/2019 | Hillegonds et al. | |
| 2020/0391891 | A1 | 12/2020 | Xu | |
| 2020/0391916 | A1 * | 12/2020 | Geiger | B65D 63/1072 |
| 2022/0402667 | A1 | 12/2022 | Geiger et al. | |
| 2023/0079482 | A1 | 3/2023 | Poupinet et al. | |
| 2023/0126004 | A1 | 4/2023 | Fukuda et al. | |
| 2023/0349491 | A1 | 11/2023 | Fish | |

FOREIGN PATENT DOCUMENTS

| | | |
|---|---|---|
| CN | 101541594 | 9/2009 |
| CN | 102123920 | 7/2011 |
| CN | 102245913 | 11/2011 |
| CN | 102398726 | 4/2012 |
| CN | 102398727 | 4/2012 |
| CN | 202670383 | 1/2013 |
| CN | 203186799 | 9/2013 |
| CN | 203237579 | 10/2013 |
| CN | 203924200 | 11/2014 |
| CN | 104736450 | 6/2015 |
| CN | 204815098 | 12/2015 |
| CN | 108625819 | 10/2018 |
| CN | 209729760 | 12/2019 |
| DE | 2612030 | 1/1977 |
| DE | 69313329 | 3/1998 |
| DE | 202004018890 | 2/2005 |
| EP | 2141397 | 1/2020 |
| EP | 3712076 | 9/2020 |
| EP | 3747781 | 12/2020 |
| FR | 2282062 | 3/1976 |
| FR | 2429921 | 1/1980 |
| GB | 1519233 | 7/1978 |
| KR | 200431100 | 11/2006 |
| KR | 20090012657 | 12/2009 |
| KR | 20110130425 | 12/2011 |
| KR | 20150064060 | 6/2015 |
| WO | 9713946 | 4/1997 |
| WO | 2005099402 | 10/2005 |
| WO | 2015008061 | 1/2015 |
| WO | 2019051624 | 3/2019 |

OTHER PUBLICATIONS

"Extended European Search Report", EP Application No. 21306256.5, dated Feb. 9, 2022, 7 pages.
"Extended European Search Report", EP Application No. 22173084.9, dated Oct. 28, 202, 6 pages.
"Extended European Search Report", EP Application No. 20177362.9, dated Nov. 20, 2020, 6 pages.
"Final Office Action", U.S. Appl. No. 12/478,863, filed Apr. 11, 2012, 10 pages.
"Foreign Office Action", KR Application No. 10-2020-0067440, dated Jan. 5, 2022, 21 pages.
"Foreign Office Action", JP Application No. 2020-098218, dated May 18, 2021, 15 pages.
"Foreign Office Action", CN Application No. 202010505104.3, dated Nov. 4, 2021, 21 pages.
"Non-Final Office Action", U.S. Appl. No. 12/478,863, filed Jul. 18, 2021, 9 pages.
"Notice of Allowance", U.S. Appl. No. 16/876,722, filed Feb. 23, 2021, 7 pages.
"Notice of Allowance", U.S. Appl. No. 17/659,767, filed Mar. 6, 2023, 7 pages.
"Notice of Allowance", U.S. Appl. No. 17/659,767, filed Apr. 11, 2023, 7 pages.
"Notice of Allowance", U.S. Appl. No. 12/478,863, filed Aug. 20, 2012, 8 pages.
"Restriction Requirement", U.S. Appl. No. 12/478,863, filed May 17, 2021, 7 pages.
"Undated Button Head Tie Product", Apr. 24, 2013, 3 pages.
"Extended European Search Report", EP Application No. 23179733.3, Nov. 13, 2023, 7 pages.

* cited by examiner

PAWL-LATCHING DEVICES

INCORPORATION BY REFERENCE

This application is a continuation of and claims priority to U.S. Non-Provisional patent application Ser. No. 17/659,767, filed on Apr. 19, 2022, which in turn claims benefit under 35 U.S.C. § 119(e) to U.S. Provisional Patent Application 63/257,047, filed on Oct. 18, 2021, U.S. Provisional Patent Application 63/214,142, filed on Jun. 23, 2021, and U.S. Provisional Patent Application 63/213,606, filed on Jun. 22, 2021, the disclosures of which are incorporated herein by reference in their entireties.

BACKGROUND

Pawl-latching devices (e.g., cable ties, clips, clamps) are plastic injection molded parts that have a long history of use for securing elongated items (e.g., wires, cables, hoses, tubing, conduits) in a bundle. A variety of different types of defects may occur in molded parts produced using conventional injection molding processes.

A first type of defect is often referred to as a "warpage defect" or "warp." A molded part that includes uneven wall thicknesses may experience a warpage defect because of stresses in step transitions (e.g., part wall sections) between the varying wall thicknesses, where the slower cooling of a thicker portion of the molded part, which is located adjacent to a thinner portion of the molded part (which cools faster), results in the warping of the thinner portion of the molded part. The thick sections will shrink more than the thin sections, causing the thin sections to be pulled towards (warp towards) the thick sections. A second type of defect is often referred to as a "sink" or "sink mark." As a molded part cools, the plastic first solidifies at the surface of the mold, and then the solidification moves inward into the part until the entire part has solidified. The thicker the part, the longer the part will take to solidify. As a result, the centers of the thickest portions of the part may still be molten when the part is ejected from the mold. During cooling of the thickest portions of a molded part, an inward pulling stress can develop that results in sinks defined on the outer surfaces of the part. Defects in molded parts, particularly those that occur in functional features, may affect the performance of the part.

To avoid these types of defects, a manufacturer may spend considerable time monitoring the quality of the parts ejected from the molds to determine if such deformities exist and what changes to the molding process are needed to prevent such deformities. These changes may include, for example, adjusting (e.g., increasing) the hold time, adjusting the holding pressure, adjusting a cooling temperature of the molds, and the like. Such changes may result in a slowing of the production of parts and may result in reduced production quantities output.

In the molding of pawl-latching devices, warp and sink defects in pawl teeth profiles are undesirable because they impact the visual appearance of the products produced. Further, as discussed above, such warps and sinks could further result in poor product performance issues, for example, by potentially reducing the pawl teeth-to-strap serration engagement, possibly lowering the retention strength provided by the pawl-latching device when secured around elongate items.

SUMMARY

This document describes techniques and apparatuses directed at improved pawl-latching devices.

In an aspect, disclosed is a pawl-latching device that includes an elongated strap with a plurality of serrations and a head. The head includes a slot, a pawl, and a pivot member. The slot extends through the head and includes a first channel conjoined with a second channel. The first channel is configured to receive the elongated strap. The pawl is disposed within the second channel of the slot, positioned internally to the head. The pawl includes a front side, a first side, a second side, a back side, a top side, and a bottom side. The pawl further has multiple pawl teeth defined in the front side that are configured to engage the plurality of serrations on the elongated strap when the elongated strap is disposed within the first channel. The pawl connects to the head at a hinged connection. The hinged connection defines a hinge axis relative to the head for the pawl to rotate about. The pivot member is defined in the bottom side of the pawl. The pivot member has a stop surface configured to contact a rear wall of the second channel when the elongated strap is disposed within the first channel and the pawl teeth engage the plurality of serrations in the elongated strap. The pivot member has a left side opposite a right side, and a notch in a center portion defined between the left side and the right side.

In another aspect, disclosed is a pawl-latching device that includes an elongated strap with a plurality of serrations and a head. The head includes a slot that extends through the head. The slot having a first channel conjoined with a second channel The first channel is configured to receive the elongated strap. The head further includes a pawl disposed within the second channel of the slot. The pawl is positioned internally to the head and includes a front side, a first side, a second side, a back side, a top side, and a bottom side. The pawl further includes multiple pawl teeth defined in the front side, the pawl teeth configured to engage the plurality of serrations on the elongated strap when the elongated strap is disposed within the first channel. The pawl connects to the head at a hinged connection. The hinged connection defines a hinge axis that the pawl is configured to pivot relative to the head. The pivot member defined in the bottom side of the pawl. The pivot member has a stop surface configured to contact a rear wall of the second channel (e.g., a ledge of the pawl hinge) when the elongated strap is disposed within the first channel and the pawl teeth engage the plurality of serrations in the elongated strap. The pivot member has a left side opposite a right side, with a center portion defined therebetween. The pivot member further has a length that extends generally parallel to the hinge axis, with a notch defined along the length in the center portion. The pawl further includes a release feature that extends from the top side of the pawl spaced apart from the front side, the second side, and the first side of the pawl.

This Summary is provided to introduce simplified concepts for improved pawl-latching devices, which are further described below in the Detailed Description and Drawings. This Summary is not intended to identify essential features of the claimed subject matter, nor is it intended for use in determining the scope of the claimed subject matter.

BRIEF DESCRIPTION OF THE DRAWINGS

The details of one or more aspects of techniques and apparatuses directed at improved pawl-latching devices are described with reference to the following Drawings, in which the use of the same numbers in different instances may indicate like features and/or components.

DETAILED DESCRIPTION

Overview

Figure 1:
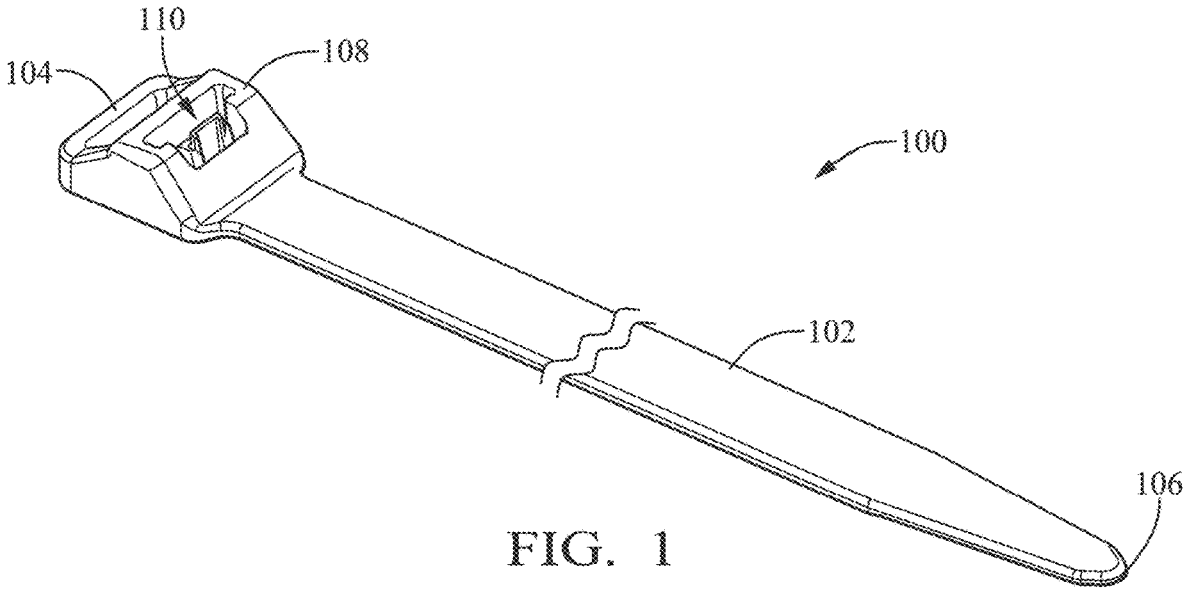
FIG. 1 is a top, perspective view of a first example implementation of an improved pawl-latching device according to implementations described herein.

This document describes techniques and apparatuses for improved injection molded pawl-latching devices. Aspects of the present disclosure further address technical problems associated with warpage defects and sinks of pawl teeth profiles, and in particular, may enable one or more of maintaining of pawl teeth-to-strap serration engagement of pawl-latching devices, maintaining the retention strength provided by the pawl-latching device when secured around elongate items, decreasing manufacturing costs associated with injection molded pawl-latching devices, and/or increasing the production speed of injection molded pawl-latching devices.

An example pawl-latching device is described herein that includes a head end and a tail end. The head end includes a locking head and the tail end includes an elongated strap that extends from the locking head. The elongated strap may be configured for insertion through the locking head to form a loop (e.g., a loop around a bundle of elongate objects). The term "bundle" used herein refers to any object or objects that may be secured by a pawl-latching device. Common examples of a bundle, which is securable via an example pawl-latching device, include a bundle of wires, cables, lines, hoses, tubing, conduit, or other objects (e.g., elongate objects) that need securing. Additional example implementations of securing a bundle include securing vines to trellises, small trees to stakes, animal fencing to poles, etc. The locking head may include a pawl mechanism configured for engaging strap serrations defined on the elongated strap, thereby retaining the strap relative to the locking head. The locking head may include a release feature (e.g., unlocking tab, unlocking lever) configured to permit the pawl mechanism to be released from engagement with the strap serrations of the strap, thereby enabling the pawl-latching device to be removed from securing the bundle. The release feature may be configured to enable an operator to digitally manipulate (e.g., utilizing a finger of the operator, utilizing a tool) the release feature to disengage the pawl teeth on the pawl from engagement with the strap serrations. Disengagement of the pawl teeth from the strap serrations permits the elongated strap to be withdrawn from the locking head and the pawl-latching device to be removed from securing the bundle.

The pawl-latching device may be formed to include at least one notch defined in a portion of the pivot member of the pawl for reducing warpage defects and sinks of pawl teeth profiles of the pawl. In addition, the pawl-latching device may be formed to include an open cavity defined in the bottom of the pawl for reducing warpage defects and sinks of pawl teeth profiles of the pawl. Further, the pawl-latching device may be formed to provide a generally uniform wall thickness in the pawl for reducing warpage defects and sinks of pawl teeth profiles of the pawl. In aspects, the pawl-latching device may be formed with a release feature structure configured for reducing warpage defects and sinks of pawl teeth profiles of the pawl. In other aspects, the pawl-latching device may be formed to include a strut and channels defined on a back side of the pawl for reducing warpage defects and sinks of pawl teeth profiles of the pawl. In further aspects, the pawl-latching device may be formed to include downwardly extending channels defined within the body of the pawl that defines a beam therebetween for reducing warpage defects and sinks of pawl teeth profiles of the pawl. One or more of these pawl-latching devices, as described in detail below, may reduce the occurrence of warpage defects and sinks of pawl teeth profiles in injection molded pawl-latching devices, thereby improving pawl-to-strap-serration engagement strength (also referred to as loop tensile strength) relative to conventional cable-tie pawls. These are but a few examples of how the described techniques and apparatuses may be used to reduce warpage defects and sinks of pawl teeth profiles in injection molded pawl-latching devices. Other examples and implementations are described throughout this document.

Pawl-Latching Devices

FIGS. 1-7B illustrate a first example implementation of an injection molded pawl-latching device 100 (e.g., cable-tie assembly) configured for reducing warpage defects and sinks of pawl teeth profiles. The pawl-latching device 100 includes an elongated strap 102 (or band) having a head end 104, and a tail end 106 that is opposite the head end 104. The pawl-latching device 100 also includes a locking head 108 integrally connected to the head end 104 of the strap 102. The strap 102 also includes a plurality of serrations on at least one lengthwise side of the strap 102, which may be configured to engage a pawl mechanism 110 within the locking head 108. For example, the plurality of serrations are illustrated in FIG. 6B as serrations 602, which are disposed on a bottom side of the strap 102. As is described in more detail below, the pawl mechanism 110 is disposed within an interior of the locking head 108. The pawl-latching device 100 described herein is merely an example in which the pawl-latching device can be implemented; any suitable pawl-latching device can be used to implement the pawl-latching device, such as clips and clamps.

The locking head 108 has a top side 202 and a bottom side 204, with a slot 206 defined therebetween. The slot 206 has a first channel 208 and a second channel 210 conjoined with the first channel 208. The slot 206 extends through the locking head 108. The first channel 208 may be configured to receive the elongated strap 102, such as the tail end 106 of the strap 102. The slot 206 may include a rear wall 232 opposite a front wall 234. The pawl mechanism 110 may be disposed within the second channel 210 of the slot 206 such that when the strap 102 is disposed within the first channel 208, the pawl mechanism 110 engages the strap 102 to allow unidirectional movement of the strap 102 through the first channel 208 in a first direction and resist movement of the strap 102 in an opposite direction. The locking head 108 may further include a buckle 212 defining a buckle channel 214 through the locking head 108. The buckle 212 provides an alternative attachment point, for example, as a slot configured to receive the elongated strap of another pawl-latching device (not illustrated).

Figure 4:
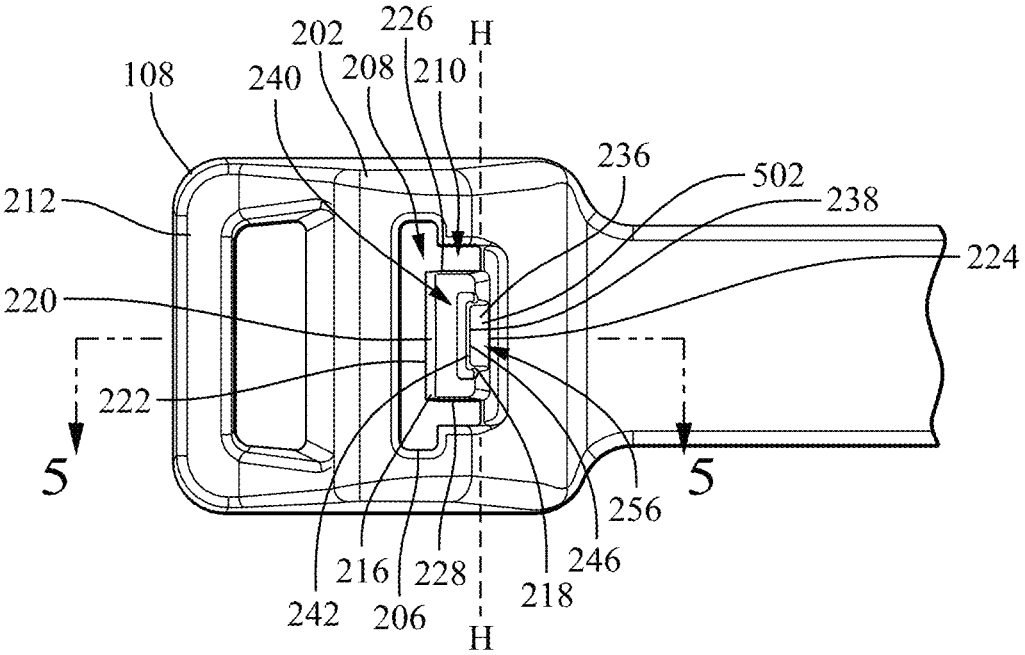
FIG. 4 is a top plan view of the locking head of the pawl-latching device of FIG. 1.
Figure 5:
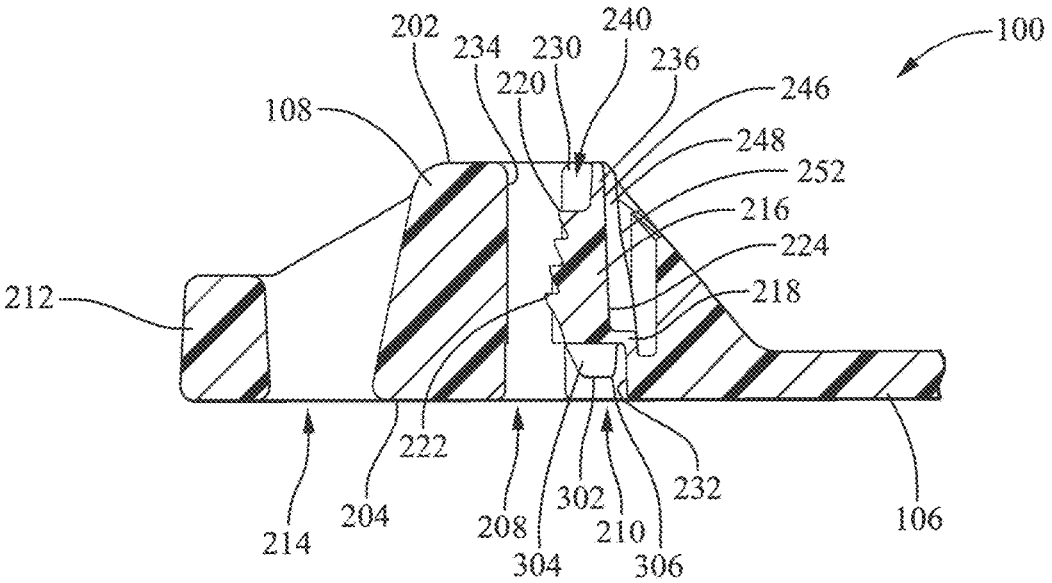
FIG. 5 is a side sectional view of the locking head of FIG. 4, taken along section line 5-5.
Figure 6A:
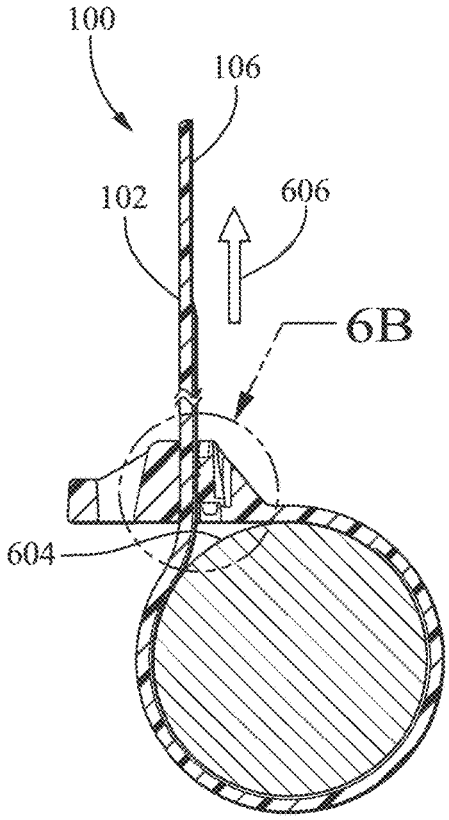
FIG. 6A is a side sectional looped and tensioning view of the pawl-latching device of FIG. 1.
Figure 6B:
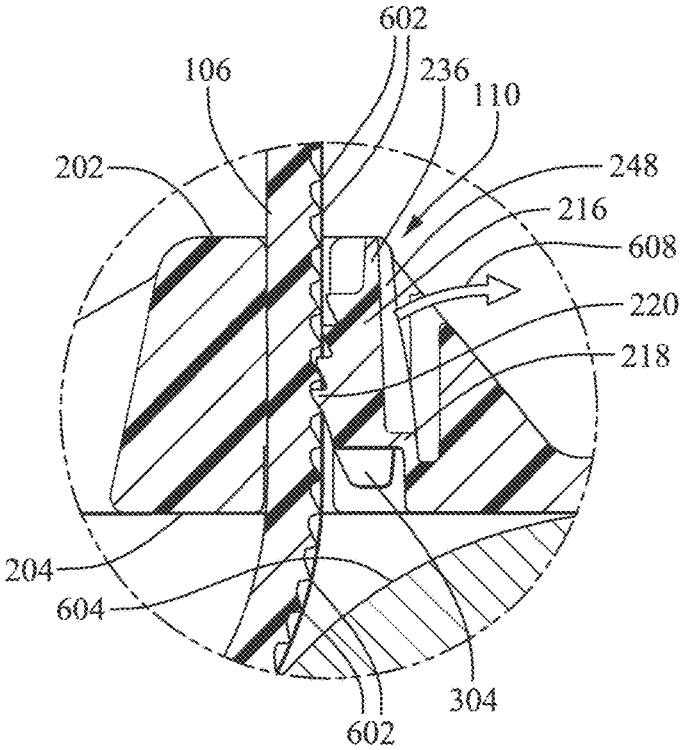
FIG. 6B is an enlarged view of the pawl-latching device illustrated in FIG. 6A, enlarged for magnification purposes.

The pawl mechanism 110 includes a pawl 216 connected to (e.g., tethered inside) the locking head 108, and forming a hinged connection 218 within the second channel 210 of the slot 206. The hinged connection 218 defines a hinge axis (H), as illustrated in FIG. 4. The pawl 216 may be configured to pivot relative to the locking head 108 at the hinge axis, as illustrated in FIG. 6B. The pawl 216 may be disposed within the second channel 210 of the slot 206 and positioned internally to the locking head 108. The pawl 216 includes multiple pawl teeth 220 defined on a front side 222 of the pawl 216. The pawl teeth 220 face the first channel 208. The pawl teeth 220 include protrusions extending from the pawl 216 toward the first channel 208 and may be angled toward one end of the first channel 208, such as toward the top side 202 (outer surface) of the locking head 108. The pawl teeth 220 may be configured to engage the plurality of serrations 602 (illustrated in FIG. 6B) on the tail end 106 of the elongated strap 102 when a portion of the tail end 106 of the elongated strap 102 is disposed within the first channel 208, as illustrated in FIG. 6A and FIG. 6B. The pawl 216 further includes a back side 224 opposite the front side 222, a first side 226 opposite a second side 228, and a top side 230 opposite a bottom side 302.

A pivot member 304 may be defined at or in the bottom side 302 of the pawl 216. The pivot member 304 may function to stop the bottom of the pawl from moving beyond the vertical ledge where hinge is attached when moderate strap tension is applied, may anchor the base of the pawl against the ledge, may reinforce the thin hinge for increased strap tension, may transform into a fulcrum or pivot for further pawl rotation at higher applied loop tension, and may add additional wedging to the pawl for optimal applied tension (at this highest tension level the pivot compresses and deforms and the hinges stretches, and the pivot provides a cam effect).

Figure 3:
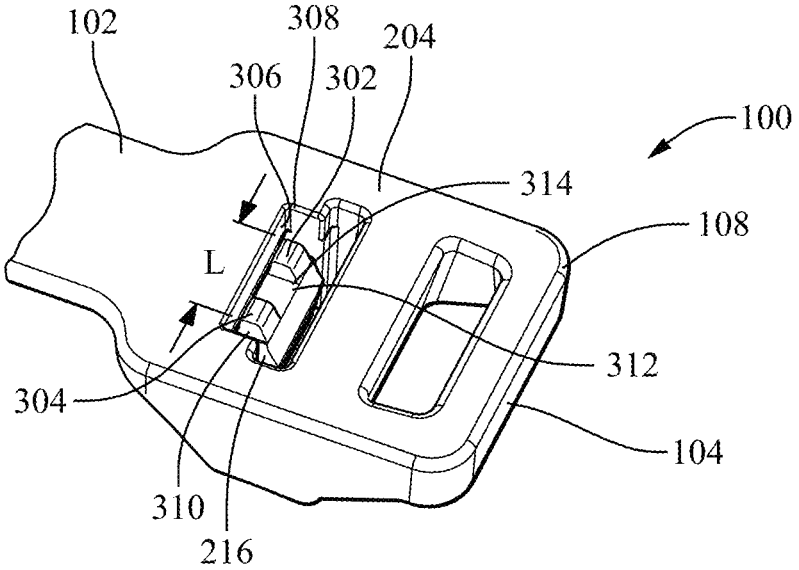
FIG. 3 is a partial, bottom perspective view of the pawl-latching device of FIG. 1.

The pivot member 304 having a stop surface 306 configured to contact the rear wall 232 of the slot 206 (e.g., second channel 210) (e.g., a ledge of the pawl hinge) when the elongated strap 102 is disposed within the first channel 208 and the pawl teeth 220 engage the plurality of serrations 602 in the elongated strap 102 under load (e.g., when the strap is moderately tensioned around a bundle), as illustrated in FIG. 6B. In FIG. 3, the pivot member 304 has a length (L). The length may extend such that it is generally parallel to the hinge axis (H). The pivot member 304 may be a single element or may be divided (e.g., bifurcated, notched) into two or more segments. In the aspect illustrated in FIG. 3, the pivot member 304 has left side 308 opposite a right side 310, with a center portion 312 defined therebetween. The pivot member 304 further may include a notch 314, which may be defined along the length in the center portion 312. In aspects, the notch 314 may be radial to the hinge axis (H). The inclusion of the notch 314 in the pivot member 304 may result in the avoidance of geometry that contributes to sinking and warping, while enabling the pivot member 304 to function to limit the rotation of the pawl 216 relative to the locking head 108. In aspects, a notch may not be present in the pivot member.

The pawl 216 may be positioned internal to the locking head 108 such that the pawl 216 (e.g., the release feature 236 of the pawl 216) does not extend above the top side 202 of the locking head 108 (e.g., the pawl 216 does not protrude longitudinally out of the slot 206/second channel 210) and/or such that the pawl 216 (e.g., bottom side 302, pivot member 304) does not extend below a bottom side 204 of the locking head 108 (e.g., the pawl 216 does not protrude longitudinally out of the slot 206/second channel 210). In such a configuration, illustrated in FIGS. 1-7B, the release feature 236 may be generally flush with or recessed below the top side 202 of the locking head 108 and the pawl 216 at least substantially contained within the locking head 108. In other aspects (not illustrated), one or more of the pawl or release feature may extend beyond the top side of the locking head, such that the pawl and/or locking head protrudes longitudinally out of the second channel.

The pawl 216 may include the release feature 236 defined by a walled structure 238 integrally connected to the pawl 216 at the top side 230 of the pawl 216. The walled structure 238 may be spaced apart from at least one of the front side 222 of the pawl 216 to define a recess 240 for receiving a tip of a user's finger (further illustrated in FIGS. 7A and 7B), the tip of a release tool (e.g., an industry-standard flat-blade screwdriver), or another object usable to release the pawl mechanism 110 from engagement with the strap serrations 602 of the elongated strap 102. Any suitable shape for the walled structure 238 can be used. In FIGS. 1-7B, the walled structure 238 is illustrated as a multi-walled structure (e.g., three-walled structure) having a fore wall 242, a first side wall 248, and a second side wall 250. In aspects, the fore wall 242 is merged with upper portions of the first side wall 248 and the second side wall 250 to form a U-shaped structure defining a feature channel 502 defined in the back wall 246 of the release feature 236 extending to the back side 224 of the pawl 216. The presence of the feature channel 502 may result in the avoidance of geometry that contributes to sinking and warping. In other examples, the walled structure 238 may be a single wall, may include two walls forming a V-shape, may include four or more walls forming a shape suitable to fit the contour of the release tool, and the like.

The release feature 236 extends from the top side 230 of the pawl 216. The release feature 236 (e.g., the walled structure 238) may be spaced apart from one or more of the front side 222, the first side 226, and the second side 228 of the pawl 216. The spacing of the release feature 236 (e.g., the walled structure 238) apart from one or more of the front side 222, the second side 228, or the first side 226 may result in the avoidance of geometry that contributes to sinking and warping.

The first side wall 248 and the second side wall 250 may extend from the top side 230 of the pawl 216 along the back side 224 of the pawl 216 to the hinged connection 218. The elongated first side wall 248 and elongated second side wall 250 may function as struts configured to reinforce the connection between the pawl 216 and the hinged connection 218 to provide increased wedging strength during high-loop tensile-strength applications. For example, the first side wall 248 may define a first strut 252 on the back side 224 of the pawl 216, the first strut 252 extending from the hinged connection 218 to the top side 230 of the pawl 216. Likewise, the second side wall 250 may define a second strut 254 on the back side 224 of the pawl 216, the second strut 254 extending from the hinged connection 218 to the top side 230 of the pawl 216. In aspects, the second strut 254 may be spaced apart from the first strut 252, defining at least one channel 256 therebetween. The fore wall 242 may also be configured to reinforce the first side wall 248 and second side wall 250 to provide increased wedging strength during high-loop tensile-strength applications. Further, integration of the first side wall 248, the second side wall 250, and the fore wall 242 provides reinforcement strength to the fore wall 242 for disengaging the pawl teeth 220 when the pawl teeth 220 are compressively engaged with the serrations 602 on the tail end 106 of the strap 102 and a user's finger or a release tool applies a force against the fore wall 242 of the release feature 236 to move the pawl 216 away from the strap 102.

FIGS. 6A and 6B illustrate the pawl teeth 220 engaging the serrations 602 on the tail end 106 of the elongated strap 102 when a portion of the tail end 106 of the strap 102 disposed within the first channel 208 when the pawl-latching device 100 is secured around a bundle 604. The strap 102 of the pawl-latching device 100 is illustrated wrapped around the bundle 604, and the tail end 106 of the strap 102 is inserted through the first channel 208 in a first direction, such that serrations 602 on the strap 102 face the pawl teeth 220 of the pawl 216 located in the second channel 210. In such a configuration, as the strap 102 moves longitudinally through the first channel 208 (as indicated by arrow 606), the angled portion of the serrations 602 engage the angled portion of the pawl teeth 220 on the pawl 216, causing the pawl 216 to rotate away from the strap 102 about its hinged connection 218 to the locking head 108, as indicated by arrow 608.

Figure 7A:
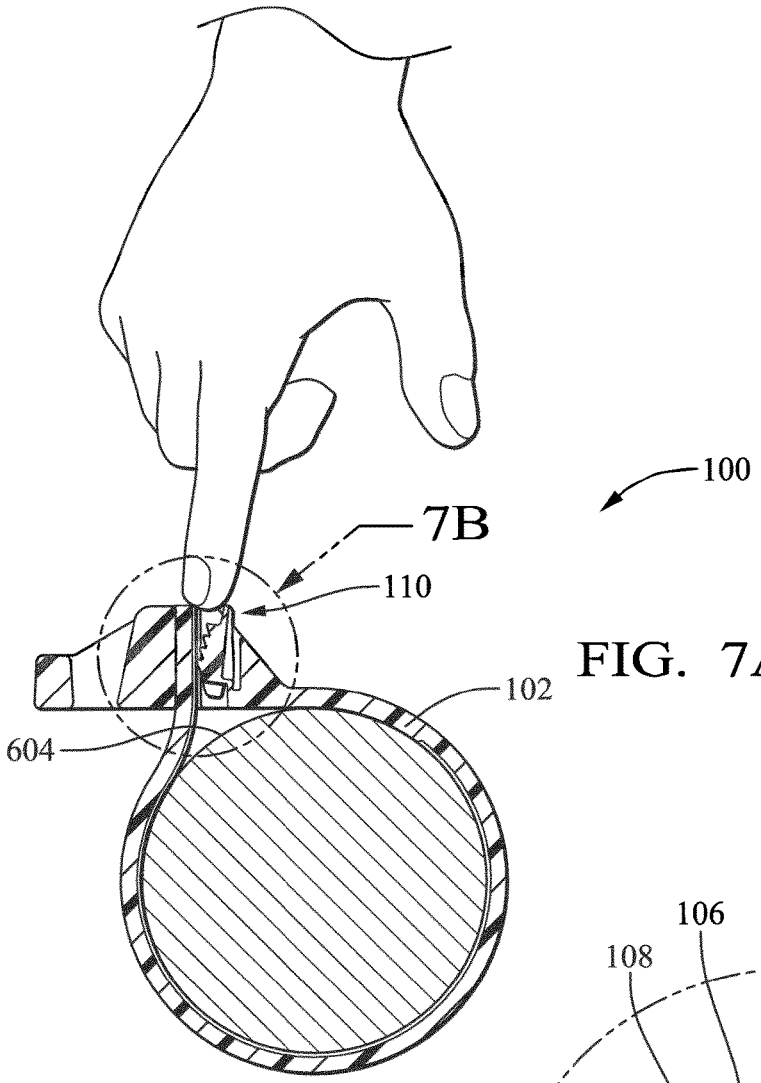
FIG. 7A is a side sectional looped view of the pawl-latching device of FIG. 6A, illustrating an operation of the release feature.
Figure 7B:
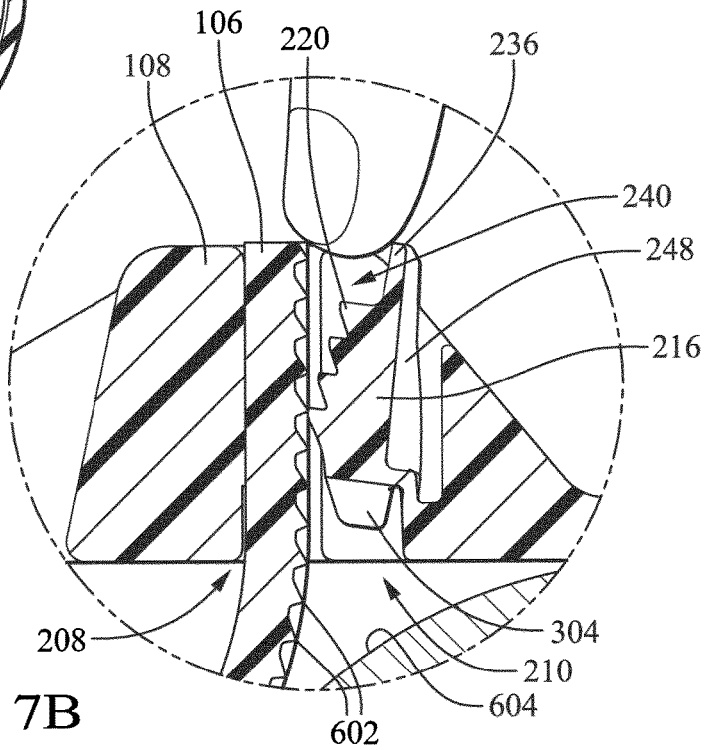
FIG. 7B is an enlarged view of the pawl-latching device illustrated in FIG. 7A, enlarged for magnification purposes.
Figure 8:
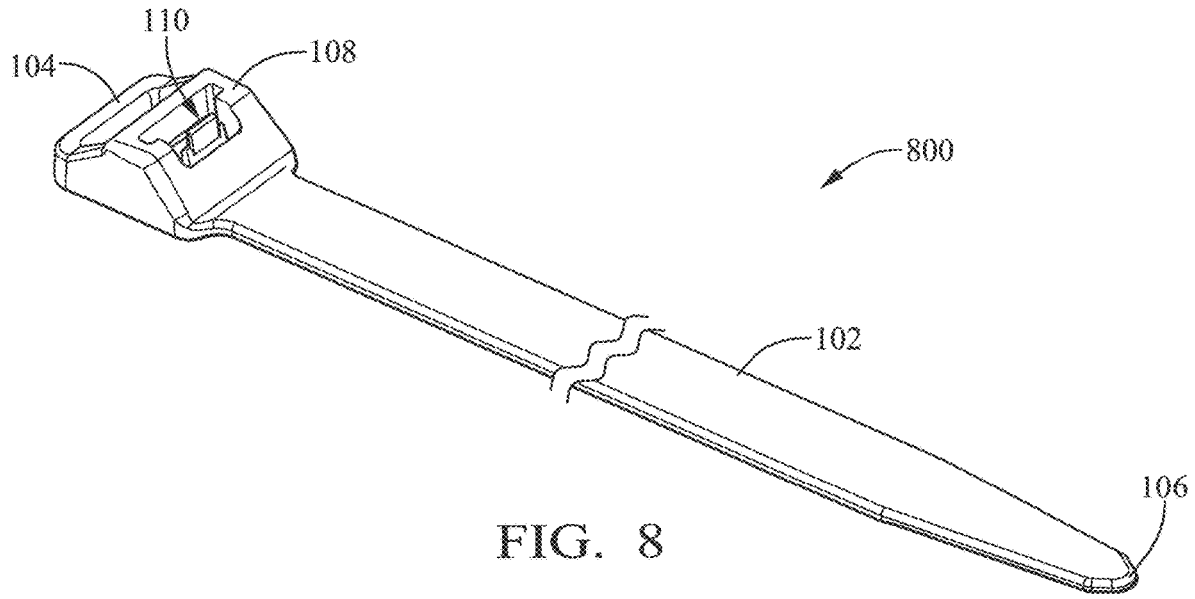
FIG. 8 is a top perspective view of a second example implementation of an improved pawl-latching device according to implementations described herein
Figure 9:
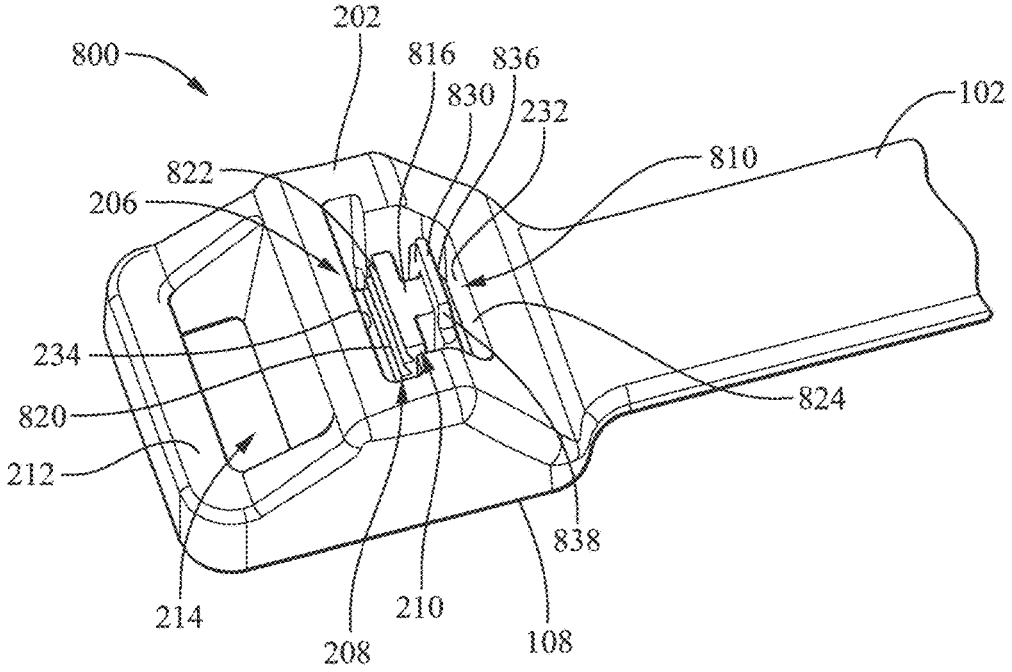
FIG. 9 is a partial, top perspective view of the pawl-latching device of FIG. 8.
Figure 10:
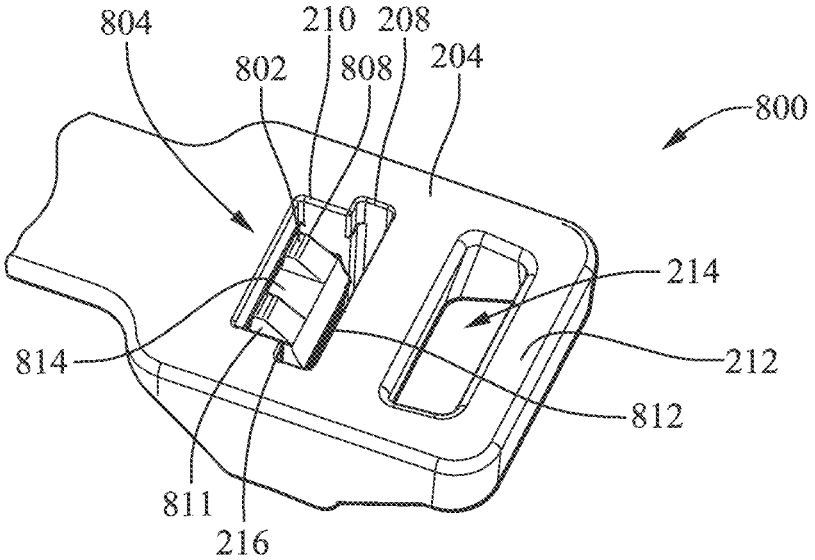
FIG. 10 is a partial, bottom perspective view of the pawl-latching device of FIG. 8.

FIGS. 7A and 7B illustrate an example operation of the release of the pawl mechanism 110 where the tip of a finger of a user is pressed against the release feature 236, causing the pawl 216 to hinge at the hinged connection 218 relative to the locking head 108, disengaging the pawl teeth 220 of the pawl 216 from the serrations 602 of the tail end 106 of the pawl-latching device 100. In aspects, the tip of a release tool (e.g., an industry-standard flat-blade screwdriver) or another object may be used to release the pawl mechanism 110 from engagement with the strap serrations 602 of the elongated strap 102.

FIGS. 8-14B illustrate a second example implementation of an injection molded pawl-latching device 800 configured for reducing warpage defects and sinks of pawl teeth profiles. The second example implementation is similar to the first example implementation of a pawl-latching device 100 illustrated in FIGS. 1-7B and described above, except as detailed below. Thus, the pawl-latching device 800 includes an elongated strap 102, a head end 104, a tail end 106 (having a plurality of serrations 602 (illustrated in FIG. 14B)), a locking head 108 (having a top side 202, a bottom side 204, a slot 206, a first channel 208, a second channel 210, a rear wall 232, and a front wall 234), and a buckle 212 (having a buckle channel 214).

The pawl-latching device 800 further includes a pawl mechanism 810 within the locking head 108. The pawl mechanism 810 having a pawl 816 with pawl teeth 820, a front side 822, a back side 824, a first side 826, a second side 828, a top side 830, a bottom side 802, a pivot member 804, a stop surface 806, a pivot member left side 808, a pivot member right side 811, a pivot member center portion 812, and a pivot member notch 814. In aspects, a notch may not be present in the pivot member.

Figure 11:
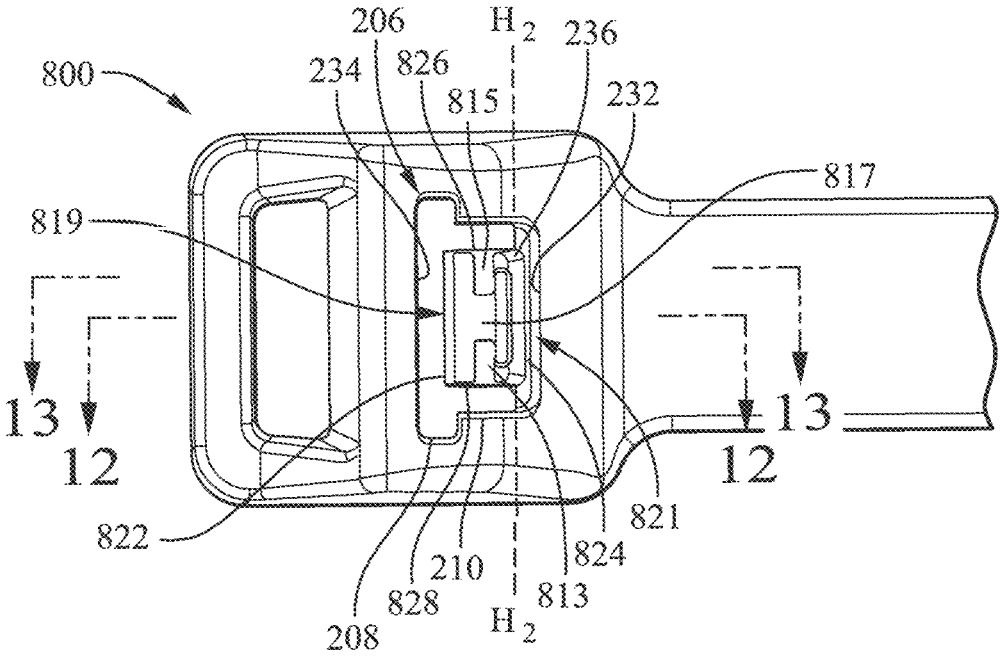
FIG. 11 is a top plan view of the locking head of the pawl-latching device of FIG. 8.
Figure 12:
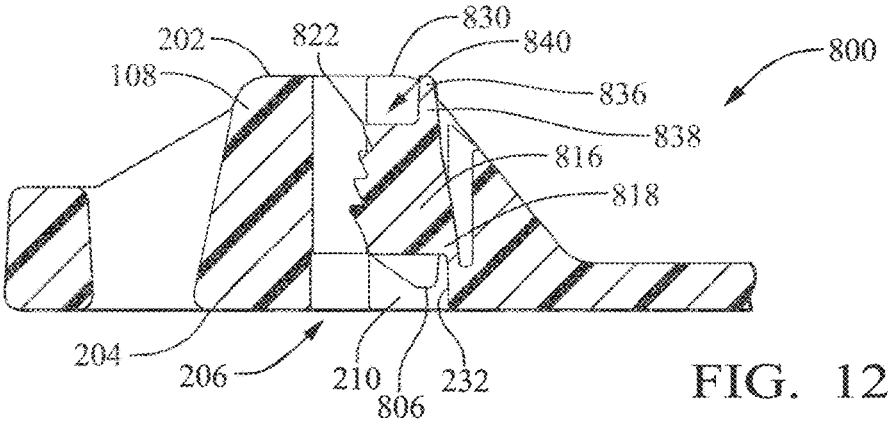
FIG. 12 is a side sectional view of the locking head of FIG. 11, taken along section line 12-12.
Figure 13:
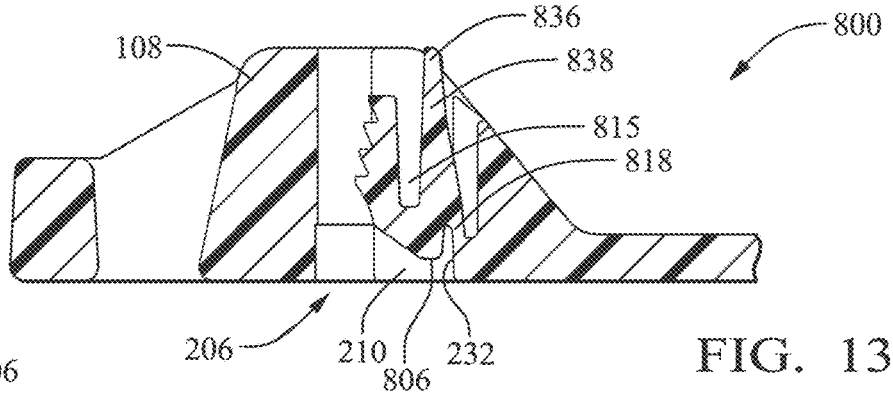
FIG. 13 is a side sectional view of the locking head of FIG. 11, taken along section line 13-13.
Figure 14A:
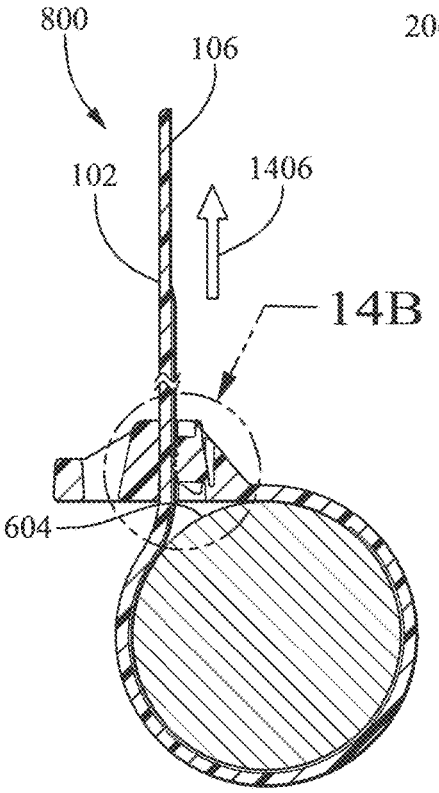
FIG. 14A is a side sectional looped and tensioning view of the pawl-latching device of FIG. 8.
Figure 14B:
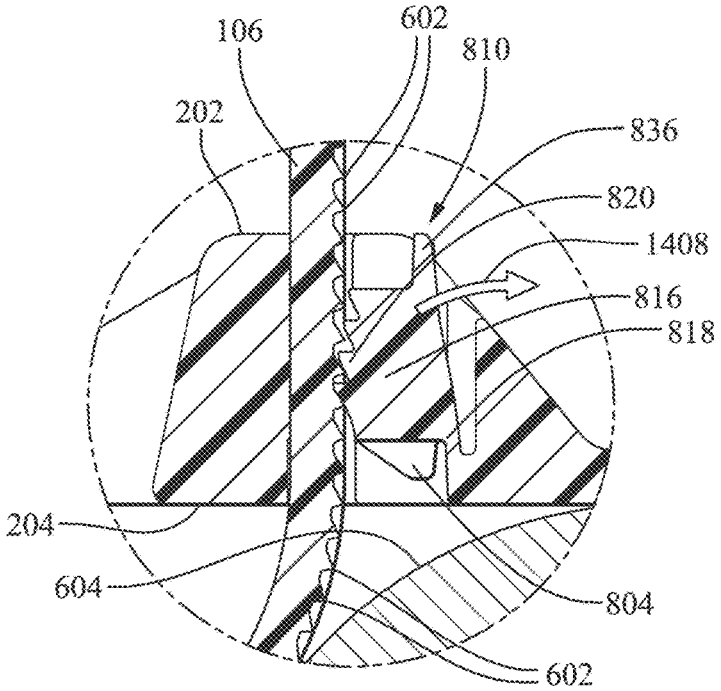
FIG. 14B is an enlarged view of the pawl-latching device illustrated in FIG. 14A, enlarged for magnification purposes.
Figure 15:
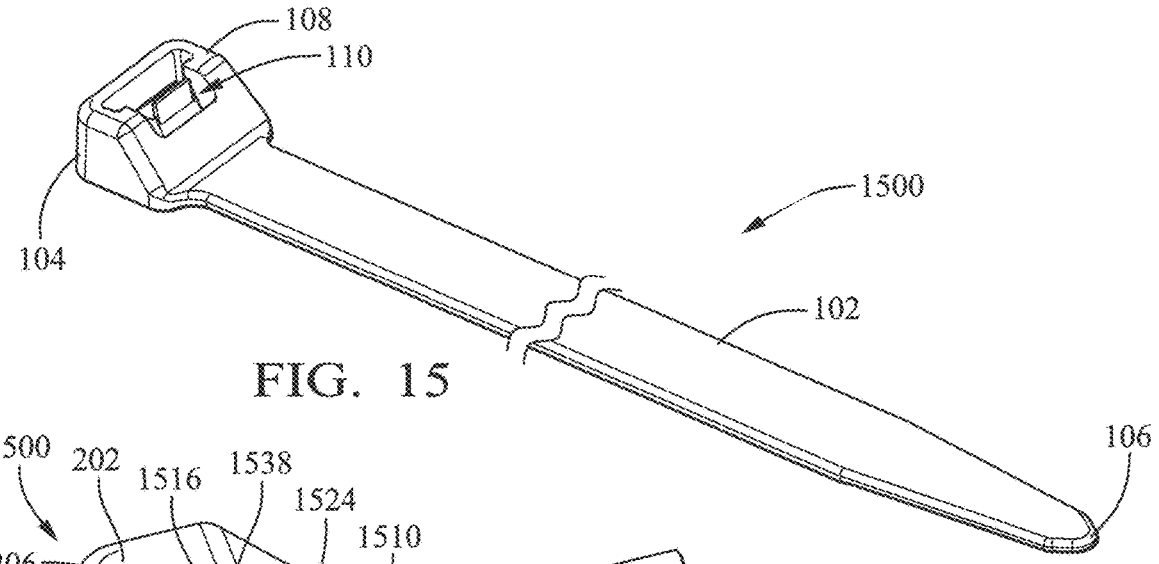
FIG. 15 is a top perspective view of a third example implementation of an improved pawl-latching device according to implementations described herein.
Figure 16:
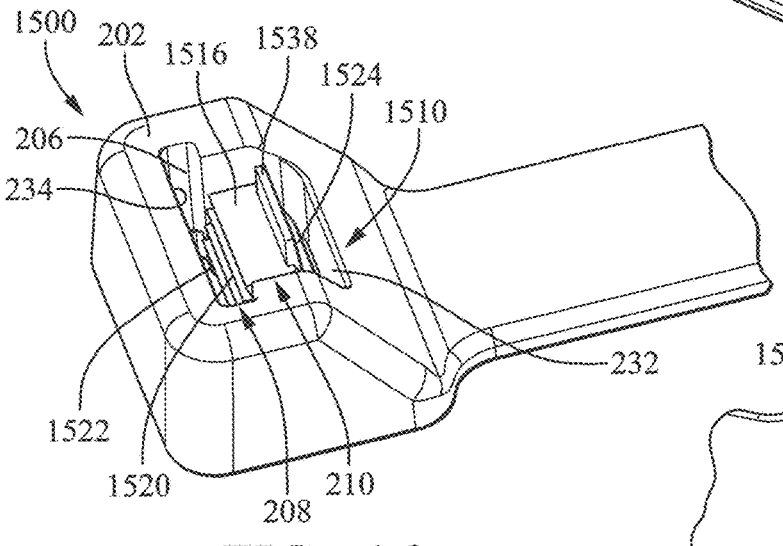
FIG. 16 is a partial, top perspective view of the pawl-latching device of FIG. 15.

The pawl 816 is connected to (e.g., tethered inside) the locking head 108, forming a hinged connection 818 within the second channel 210 of the slot 206. The hinged connection 818 defines a hinge axis ($H_2$), as illustrated in FIG. 11. The pawl 816 may be configured to pivot about the hinge axis, relative to the locking head 108, as illustrated in FIG. 14B. The inclusion of the notch 814 in the pivot member 804 may prevent sinking and warping, while enabling the pivot member 804 to function to enhance the rotation of the pawl 816 relative to the locking head 108.

The pawl teeth 820 of the pawl-latching device 800 may be configured to engage the plurality of serrations 602 on the tail end 106 of the elongated strap 102 when a portion of the tail end 106 of the elongated strap 102 may be disposed within the first channel 208. For example, when the pawl-latching device 800 is secured around a bundle 604, as illustrated in FIGS. 14A and 14B. The strap 102 of the pawl-latching device 800 is configured to wrap around the bundle 604, and the tail end 106 of the strap 102 may be inserted through the first channel 208 in a first direction such that serrations 602 on the strap 102 face the pawl teeth 820 of the pawl 816 located in the second channel 210. In such a configuration, as the strap 102 moves longitudinally through the first channel 208 (as indicated by arrow 1406 in FIG. 14A), the angled portion of the serrations 602 engage the angled portion of the pawl teeth 820 on the pawl 816, causing the pawl 816 to rotate away from the strap 102 about its hinged connection 818 to the locking head 108 (as indicated by arrow 1408 in FIG. 14B).

Figure 2:
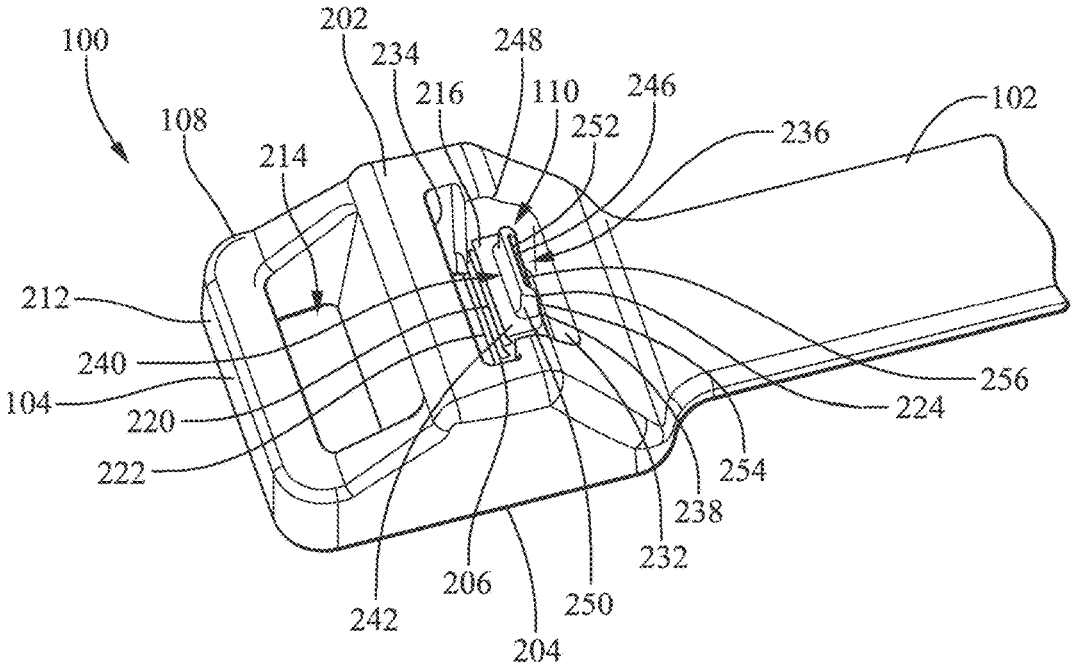
FIG. 2 is a partial, top perspective view of the pawl-latching device of FIG. 1.

The pawl 816 may include a release feature 836 (e.g., release feature 236 in FIG. 2). In the aspect illustrated in FIGS. 8-14B, the release feature 836 may be defined by an unlocking tab 838 extending from the top side 830 of the pawl 816, spaced apart from at least one of the front side 822, the second side 828, and the first side 826 of the pawl 816. The spacing of the unlocking tab 838 apart from one or more of the front side 822, the second side 828, or the first side 826 may prevent, or otherwise result in the avoidance of geometry that contributes to, sinking and warping. Any suitable shape for the unlocking tab 838 can be used. In FIGS. 8-14B, the unlocking tab 838 is illustrated as a single wall. The unlocking tab 838 may be a multi-walled structure (e.g., a three-walled structure having a fore wall, a first side wall, and a second side wall), with the fore wall merged with upper portions of the first side wall and the second side wall to form a U-shaped structure defined around at least one feature channel in the back face of the release feature extending to the back side of the pawl, as illustrated with respect to the aspect of FIGS. 1-7B. In other examples, the unlocking tab 838 may be in the shape of an "I" beam. In further examples, the unlocking tab 838 may include two walls forming a V-shape, may include four or more walls forming a shape suitable to fit the contour of the release tool, and the like. The unlocking tab 838 may be spaced apart from the front side 822 of the pawl 816 to define a recess 840 for receiving a tip of a user's finger (as illustrated in FIGS. 7A and 7B with respect to pawl-latching device 100), the tip of a release tool (e.g., an industry-standard flat-blade screwdriver) or another object usable to release the pawl mechanism 810 from engagement with the strap serrations 602 of the elongated strap 102.

In the configuration illustrated in FIGS. 8-14B, the top side 830 may be generally flush with or recessed below a top side 202 of the locking head and the pawl 816 is at least substantially contained within the locking head 108. In other aspects (not illustrated), one or more of the pawl or release feature may extend beyond the top side of the locking head, such that the pawl and/or locking head protrudes longitudinally out of the second channel.

In the aspect illustrated in FIGS. 8-14B, a first channel 813 and a second channel 815 may be defined in the pawl 816. The first channel 813 extends from the top side 830, towards the bottom side 802 of the pawl 816. The second channel 815 extends from the top side 830, towards the bottom side 802 of the pawl 816. The first channel 813 and the second channel 815 define a support wall 817 therebetween, the support wall 817 connecting at a first end with a front portion 819 of the pawl 816 and at a second end with a rear portion 821 of the pawl 816. The pawl teeth 820 may be defined in the front portion 819. In such a configuration, the pawl 816 includes an I-shaped beam structure.

The inclusion of the first channel 813 and the second channel 815 may prevent a change in geometry that contributes to sinking and warping. The support wall 817 may function to reinforce front portion 819 relative to the rear portion 821 to provide increased wedging strength during high-loop tensile-strength applications. This may provide reinforcement strength to the pawl 816 for disengaging the pawl teeth 820, such as, when the pawl teeth 820 are compressively engaged with the serrations 602 on the tail end 106 of the strap 102 and a user's finger or a release tool applies a force against the release feature 836 to move the pawl 216 away from the strap 102.

The pawl mechanism 810 of the pawl-latching device 800 may be configured to operate similarly to the release of the pawl mechanism 110 of the pawl-latching device 100 illustrated in FIGS. 7A and 7B, where the tip of a finger of a user is illustrated pressed against the release feature, causing the pawl to hinge at the hinged connection relative to the locking head and disengaging the pawl teeth of the pawl from the serrations of the tail end of the pawl-latching device. In aspects, the tip of a release tool (e.g., an industry-standard flat-blade screwdriver) or another object may be usable in lieu of the tip of a finger of a user.

FIGS. 15-20B illustrate a third example implementation of an injection molded pawl-latching device 1500 configured for reducing warpage defects and sinks of pawl teeth profiles. The third example implementation is similar to the first example implementation of a pawl-latching device 100 illustrated in FIGS. 1-7B and described above, except as detailed below. Thus, the pawl-latching device 1500 includes an elongated strap 102, a head end 104, a tail end 106 (having a plurality of serrations 602), and a locking head 108 (having a top side 202, a bottom side 204, a slot 206, a first channel 208, a second channel 210, a rear wall 232, and a front wall 234).

The pawl-latching device 1500 further includes a pawl mechanism 1510 within the locking head 108. The pawl mechanism 1510 having a pawl 1516 with pawl teeth 1520, a front side 1522, a back side 1524, a first side 1526, a second side 1528, a top side 1530, a bottom side 1502, a pivot member 1504, a stop surface 1506, a pivot member left side 1508, a pivot member right side 1511, a pivot member center portion 1512, and a pivot member notch 1514. In aspects, a notch may not be present in the pivot member.

Figure 18:
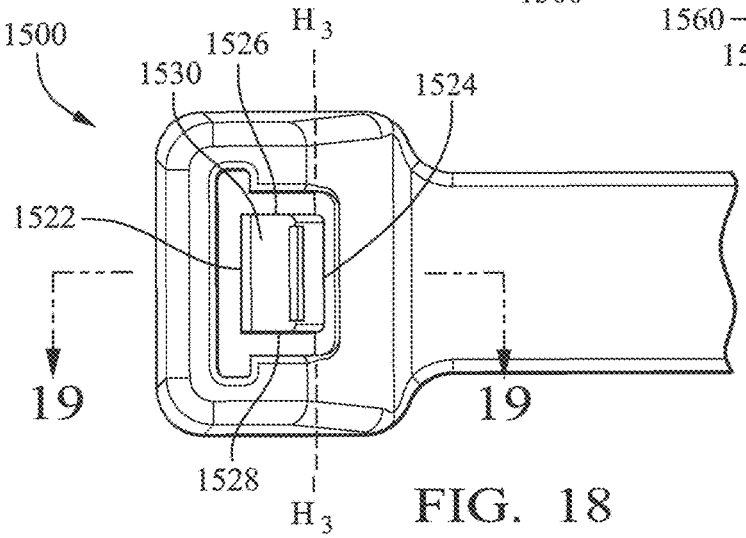
FIG. 18 is a top plan view of the locking head of the pawl-latching device of FIG. 15.
Figure 20A:
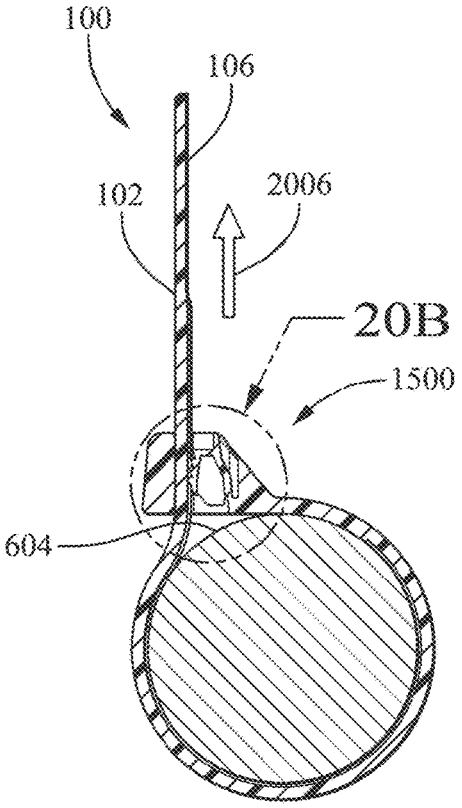
FIG. 20A is a side sectional looped and tensioning view of the pawl-latching device of FIG. 15.
Figure 20B:
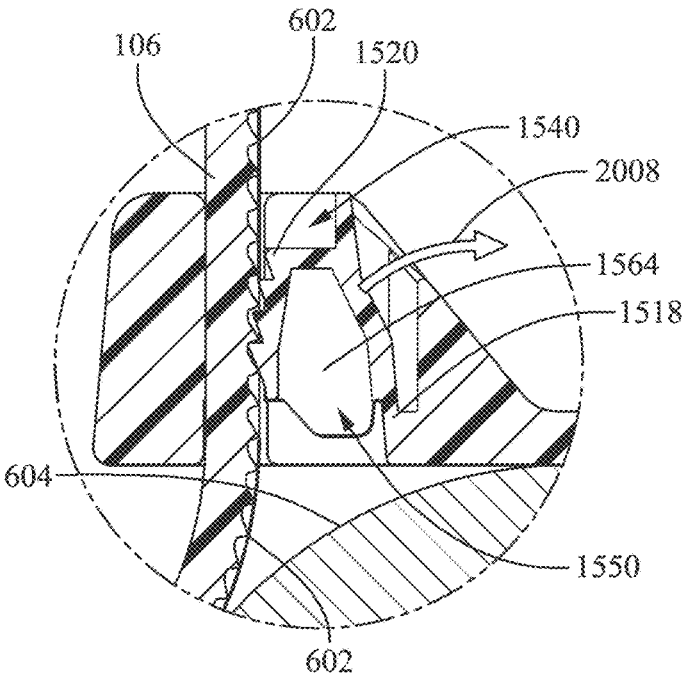
FIG. 20B is an enlarged view of the pawl-latching device illustrated in FIG. 20A, enlarged for magnification purposes.

The pawl 1516 is connected to (e.g., tethered inside) the locking head 108, forming a hinged connection 1518 within the second channel 210 of the slot 206. The hinged connection 1518 defines a hinge axis ($H_3$), as illustrated in FIG. 18. The pawl 1516 may be configured to pivot relative to the locking head 108 at the hinge axis, as illustrated in FIG. 20B. The inclusion of the pivot member notch 1514 in the pivot member 1504 may result in the avoidance of geometry that contributes to sinking and warping, while enabling the pivot member 1504 to function to limit the rotation of the pawl 1516 relative to the locking head 108.

Figure 17:
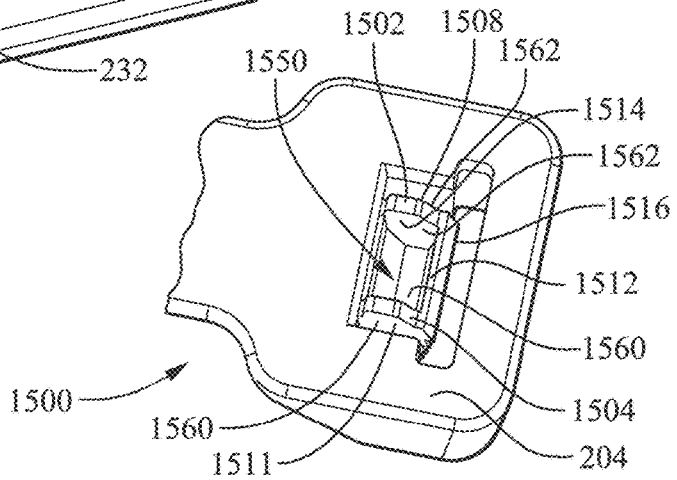
FIG. 17 is a partial, bottom perspective view of the pawl-latching device of FIG. 15.
Figure 19:
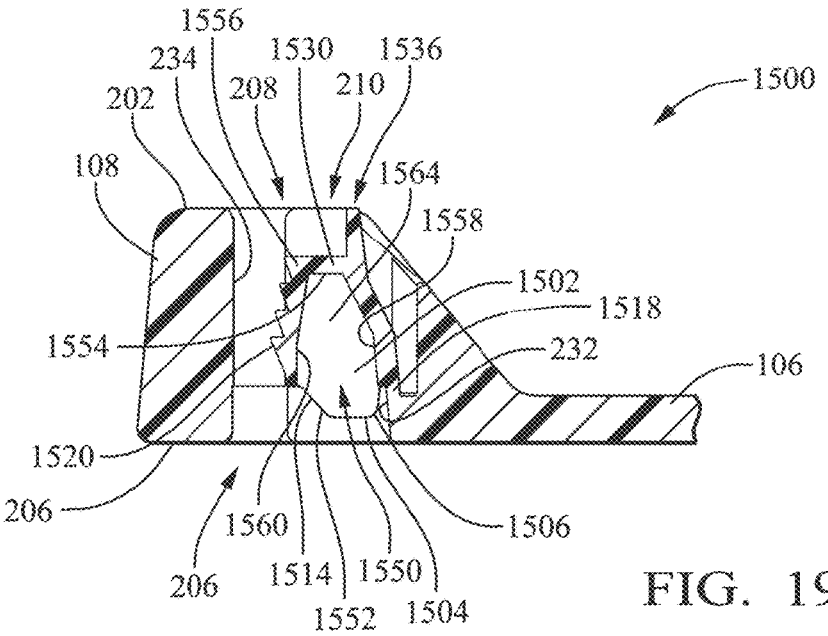
FIG. 19 is a side sectional view of the locking head of FIG. 18, taken along section line 19-19.

In aspects, the pawl-latching device 1500 may include an open cavity 1550 defined in the pawl 1516, for example, as illustrated in FIGS. 17, 19, and 20B. The open cavity 1550 may extend from an open bottom 1552 in the notch 1514 into the pawl 1516 in the direction of the top side 1530 of the pawl 1516. The open cavity 1550 may include a top wall 1554 defined in a top portion 1556 of the pawl 1516, the top wall 1554 opposite the open bottom 1552. The open cavity 1550 may further include a back wall 1558 opposite a front wall 1560 and a first side wall 1562 opposite a second side wall 1564. In aspects, the back wall 1558, the front wall 1560, the first side wall 1562, and the second side wall 1564 connect to the top wall 1554 to define the open cavity 1550. A thickness of the back wall 1558 may be generally uniform with a thickness of at least one of the front wall 1560, the first side wall 1562, or the second side wall 1564. A thickness of the first side wall 1562 may be generally uniform, with a thickness of at least one of the back wall 1558, the front wall 1560, or the second side wall 1564. In aspects, the thicknesses of the back wall 1558, the front wall 1560, the first side wall 1562, and the second side wall 1564 are generally uniform. The inclusion of the open cavity 1550 in the pawl 1516 may result in the avoidance of geometry that contributes to sinking and warping.

The pawl teeth 1520 of the pawl-latching device 1500 may be configured to engage the plurality of serrations 602 on the tail end 106 of the elongated strap 102 when a portion of the tail end 106 of the elongated strap 102 is disposed within the first channel 208. For example, when the pawl-latching device 1500 is secured around a bundle 604, as illustrated in FIGS. 20A and 20B. The strap 102 of the pawl-latching device 1500 is configured to wrap around the bundle 604, and the tail end 106 of the strap 102 is inserted through the first channel 208 in a first direction such that serrations 602 on the strap 102 face the pawl teeth 1520 of the pawl 1516 located in the second channel 210. In such a configuration, as the strap 102 moves longitudinally through the first channel 208 (as indicated by arrow 2006 in FIG. 20A), the angled portion of the serrations 602 engage the angled portion of the pawl teeth 1520 on the pawl 1516, causing the pawl 1516 to rotate away from the strap 102 about its hinged connection 1518 to the locking head 108 (as indicated by arrow 2008 in FIG. 20B).

The pawl 1516 may include a release feature 1536 (e.g., release feature 236 in FIG. 2). In the aspect illustrated in FIGS. 15-20B, the release feature 1536 may be defined by a flange 1538 extending from the top side 1530 of the pawl 1516, spaced apart from at least one of the front side 1522, the second side 1528, and the first side 1526 of the pawl 1516. The spacing of the flange 1538 apart from one or more of the front side 1522, the second side 1528, or the first side 1526 may result in the avoidance of geometry that contributes to sinking and warping. Any suitable shape for the flange 1538 can be used. In FIGS. 15-20B, the flange 1538 is illustrated as a single wall. The flange 1538 may be a multi-walled structure (e.g., a three-walled structure having a fore wall, a first side wall, and a second side wall), with the fore wall merged with upper portions of the first side wall and the second side wall to form a U-shaped structure defining at least one feature channel in the back face of the release feature extending to the back side of the pawl, as illustrated with respect to the aspect of FIGS. 1-7B. In other examples, the flange 1538 may include two walls forming a V-shape, may include four or more walls forming a shape suitable to fit the contour of the release tool, and the like.

In the configuration illustrated in FIGS. 15-20B, the top side 1530 may be generally flush with or recessed below a top side 202 of the locking head and the pawl 1516 is at least substantially contained within the locking head 108. In other aspects (not illustrated), one or more of the pawl or release feature may extend beyond the top side of the locking head, such that the pawl and/or locking head protrudes longitudinally out of the second channel.

The flange 1538 may be spaced apart from the front side 1522 of the pawl 1516 to define a recess 1540 for receiving a tip of a user's finger (as illustrated in FIGS. 7A and 7B with respect to pawl-latching device 100), the tip of a release tool (e.g., an industry-standard flat-blade screwdriver) or another object usable to release the pawl mechanism 1510 from engagement with the strap serrations 602 of the elongated strap 102. The pawl mechanism 1510 of the pawl-latching device 1500 may be configured to operate similarly to the release of the pawl mechanism 110 of the pawl-latching device 100 illustrated in FIGS. 7A and 7B, where the tip of a finger of a user is illustrated pressed against the release feature, causing the pawl to hinge at the hinged connection relative to the locking head and disengaging the pawl teeth of the pawl from the serrations of the tail end of the pawl-latching device. In aspects, the tip of a release tool (e.g., an industry-standard flat-blade screwdriver) or another object may be usable in lieu of the tip of a finger of a user.

After a pawl-latching device 100 is secured around the bundle 604 and tensioned, a portion of the tail end 106 of the pawl-latching device 100 may be removed, for example, by a tension and cutoff cable tie tool or other such installation tool (not illustrated). For example, an installation tool can be used to apply tension to the pawl-latching device and also shear off excess length of the strap that extends above the top side of the locking head. Such an installation tool may operate by applying tension to the pawl-latching device by pulling the strap while pushing on the top side of the locking head and using a blade to shear the strap. In such an operation, the pawl rotates toward the strap, enabling the pawl teeth on the pawl to engage the serrations on the strap and secure the pawl-latching device in place. Because the pawl-latching device is tensioned around the bundle, when the strap is sheared, the remaining strap tension is momentarily released until the pawl teeth engage serrations on the strap; thereby moving the strap in a reverse direction through the first channel and toward the bundle. Further, because the pawl and the release feature are positioned internally to the locking head, the installation tool can shear the strap substantially flush with the top side of the locking head to substantially remove any protruding, sharp edges on the strap that could pose a risk of injury to a user or damage to adjacent routed bundles, hoses, etc.

ADDITIONAL EXAMPLES

The following are additional examples of techniques and apparatuses directed to pawl-latching devices.

Example 1: A pawl-latching device comprising: an elongated strap comprising a plurality of serrations; and a head, the head comprising: a slot that extends through the head, the slot including a first channel conjoined with a second channel, the first channel configured to receive the elongated strap; and a pawl disposed within the second channel of the slot, the pawl positioned internally to the head, the pawl comprising: a front side, a first side, a second side, a back side, a top side, and a bottom side; the pawl having multiple pawl teeth defined in the front side, and configured to engage the plurality of serrations on the elongated strap when the elongated strap is disposed within the first channel; the pawl connected to the head at a hinged connection, wherein the hinged connection defines a hinge axis relative to the head for the pawl to pivot about; and a pivot member defined in the bottom side, the pivot member having a stop surface configured to contact a rear wall of the second channel when the elongated strap is disposed within the first channel and the pawl teeth engage the plurality of serrations in the elongated strap, the pivot member having a left side opposite a right side, and a notch in a center portion defined between the left side and the right side.

Example 2: The pawl-latching device of Example 1, wherein the pivot member has a length that extends generally parallel to the hinge axis.

Example 3: The pawl-latching device of Example 1 or 2, wherein the notch is defined along the length in the center portion.

Example 4: The pawl-latching device of any of Examples 1-3, further comprising, an open cavity defined in the pawl, and that extends into the pawl, from the notch, and in a direction of the top side of the pawl.

Example 5: The pawl-latching device of any of Examples 1-4, wherein the open cavity further comprises: a top wall defined in a top portion of the pawl, and opposite an open bottom in the notch, wherein connected to the top wall the open cavity further comprises: a back wall opposite a front wall; and a first side wall opposite a second side wall.

Example 6: The pawl-latching device of any of Examples 1-5, wherein a thickness of the back wall is generally uniform with a thickness of at least one of the front wall, the first side wall, or the second side wall; or wherein a thickness of the first side wall is generally uniform with a thickness of at least one of the back wall, the front wall, or the second side wall.

Example 7: The pawl-latching device of any of Examples 1-6, wherein the thicknesses of the back wall, the front wall, the first side wall, and the second side wall are generally uniform.

Example 8: The pawl-latching device of any of Examples 1-7, wherein the pawl further comprises: a release feature that extends from the top side of the pawl spaced apart from the front side, the second side, and the first side of the pawl.

Example 9: The pawl-latching device of any of Examples 1-8, wherein the top side is recessed below the top side of the head.

Example 10: The pawl-latching device of any of Examples 8 or 9, wherein the release feature is recessed below the top side of the head.

Example 11: The pawl-latching device of any of Examples 8-10, wherein the release feature further comprises: a fore wall that faces a front wall of the slot; a back wall that faces the rear wall of the slot; and a feature channel defined in the back wall.

Example 12: The pawl-latching device of any of Examples 8-11, wherein the release feature is generally U-shaped.

Example 13: The pawl-latching device of any of Examples 1-12, further comprising: a first strut on the back side of the pawl, and that extends from the hinged connection to the top side of the pawl.

Example 14: The pawl-latching device of any of Example 13, further comprising: a second strut on the back side of the pawl, and that extends from the hinged connection to the top side of the pawl, wherein the second strut is spaced apart from the first strut, and defines a channel therebetween.

Example 15: The pawl-latching device of any of Examples 1-14, wherein the pawl further comprises: a first channel defined in the pawl, the first channel that extends from the top side towards the bottom side of the pawl; and a second channel defined in the pawl, the second channel that extends from the top side towards the bottom side of the pawl, wherein the first channel and the second channel define a support wall therebetween, the support wall connects at a first end with a front portion of the pawl, the support wall connects at a second end with a rear portion of the pawl.

Example 16: A pawl-latching device comprising: an elongated strap comprising a plurality of serrations; and a head, the head comprising: a slot that extends through the head, the slot including a first channel conjoined with a second channel, the first channel configured to receive the elongated strap; and a pawl disposed within the second channel of the slot, the pawl positioned internally to the head, the pawl comprising: a front side, a first side, a second side, a back side, a top side, and a bottom side; the pawl having multiple pawl teeth defined in the front side, the pawl teeth configured to engage the plurality of serrations on the elongated strap when the elongated strap is disposed within the first channel; the pawl connected to the head at a hinged connection, wherein the hinged connection defines a hinge axis that the pawl is configured to pivot relative to the head; a pivot member defined in the bottom side, the pivot member having a stop surface configured to contact a rear wall of the second channel when the elongated strap is disposed within the first channel and the pawl teeth engage the plurality of serrations in the elongated strap, the pivot member having a left side opposite a right side, with a center portion defined therebetween, the pivot member having a length that extends generally parallel to the hinge axis, and the pivot member further comprises a notch defined along the length in the center portion; and a release feature that extends from the top side of the pawl spaced apart from the front side, the second side, and the first side of the pawl.

Example 17: The pawl-latching device of Example 16, further comprising: an open cavity defined in the pawl, and that extends into the pawl from the notch in a direction of the top side of the pawl.

Example 18: The pawl-latching device of Example 16 or 17, wherein the open cavity further comprises: a top wall defined in a top portion of the pawl, the top wall opposite an open bottom, the open bottom in the notch; a back wall opposite a front wall; and a first side wall opposite a second side wall, wherein a thickness of the back wall is uniform with a thickness of at least one of the front wall, the first side wall, or the second side wall.

Example 19: The pawl-latching device of any of Examples 16-18, further comprising: a first strut on the back side of the pawl, and that extends from the hinged connection to the top side of the pawl; and a second strut on the back side of the pawl, and that extends from the hinged connection to the top side of the pawl, the second strut spaced apart from the first strut, defining a channel therebetween.

Example 20: The pawl-latching device of any of Examples 16-19, wherein the pawl further comprises: a first channel defined in the pawl, and that extends from the top side towards the bottom side of the pawl; and a second channel defined in the pawl, and that extends from the top side towards the bottom side of the pawl, wherein the first channel and the second channel define a support wall therebetween, and that connects at a first end with a front portion of the pawl, and further connects at a second end with a rear portion of the pawl.

CONCLUSION

While various aspects of pawl-latching devices are described in the foregoing description and illustrated in the drawings, it is to be understood that this disclosure is not limited thereto but may be variously embodied to practice within the scope of the following claims. From the foregoing description, it will be apparent that various changes may be made without departing from the spirit and scope of the disclosure as defined by the following claims. Further, the specific features and methods disclosed are example implementations of pawl-latching devices, and other equivalent features and methods are intended to be within the scope of the appended claims. Additionally, various different aspects are described, and it is to be appreciated that each described aspect can be implemented independently or in connection with one or more other described aspects or parts thereof.

The use of "or" and grammatically related terms indicates non-exclusive alternatives without limitation unless the context clearly dictates otherwise. As used herein, a phrase referring to "at least one of" a list of items refers to any combination of those items, including single members. As an example, "at least one of: a, b, or c" is intended to cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

What is claimed:

1. An apparatus comprising:

a strap comprising a plurality of serrations; and a head, the head comprising:

a slot that extends through the head, the slot including a channel, the channel configured to receive the strap; and a pawl disposed within the channel of the slot, the pawl positioned internally to the head, the pawl comprising:

a front side, a first side, a second side, a back side, a top side, and a bottom side;

the pawl having multiple pawl teeth defined in the front side, and configured to engage the plurality of serrations on the strap when the strap is disposed within the channel;

the pawl connected to the head at a hinged connection; and a pivot member defined in the bottom side, the pivot member having a left side opposite a right side, and a notch in a center portion defined between the left side and the right side.

2. The apparatus of claim 1, wherein the hinged connection defines a hinge axis relative to the head for the pawl to pivot about, and wherein the pivot member has a length that extends generally parallel to the hinge axis.

3. The apparatus of claim 2, wherein the notch is defined along the length in the center portion.

4. The apparatus of claim 1, further comprising, an open cavity defined in the pawl, and that extends into the pawl, from the notch, and in a direction of the top side of the pawl.

5. The apparatus of claim 4, wherein the open cavity further comprises:

a top wall defined in a top portion of the pawl, and opposite an open bottom in the notch, wherein connected to the top wall the open cavity further comprises:

a back wall opposite a front wall; and a first side wall opposite a second side wall.

6. The apparatus of claim 5, wherein at least one of:

a thickness of the back wall is generally uniform with a thickness of at least one of the front wall, the first side wall, or the second side wall; or a thickness of the first side wall is generally uniform with a thickness of at least one of the back wall, the front wall, or the second side wall.

7. The apparatus of claim 6, wherein the thicknesses of the back wall, the front wall, the first side wall, and the second side wall are generally uniform.

8. The apparatus of claim 1, wherein the pawl further comprises:

a release feature that extends from the top side of the pawl spaced apart from the front side, the second side, and the first side of the pawl.

9. The apparatus of claim 8, wherein the top side is recessed below the top side of the head.

10. The apparatus of claim 9, wherein the release feature is recessed below the top side of the head.

11. The apparatus of claim 8, wherein the release feature further comprises:

a fore wall that faces a front wall of the slot;

a back wall that faces a rear wall of the slot; and a feature channel defined in the back wall.

12. The apparatus of claim 11, wherein the release feature is generally U-shaped.

13. The apparatus of claim 1, further comprising:

a first strut on the back side of the pawl, and that extends from the hinged connection to the top side of the pawl.

14. The apparatus of claim 13, further comprising:

a second strut on the back side of the pawl, and that extends from the hinged connection to the top side of the pawl, wherein the second strut is spaced apart from the first strut, and defines a channel therebetween.

15. The apparatus of claim 1, wherein the pawl further comprises:

a channel defined in the pawl, the channel that extends from the top side towards the bottom side of the pawl; and a channel defined in the pawl, the channel that extends from the top side towards the bottom side of the pawl, wherein the pawl channel and the pawl channel define a support wall therebetween, the support wall connects at a first end with a front portion of the pawl, the support wall connects at a second end with a rear portion of the pawl.

16. The apparatus of claim 1, further comprising:

the pivot member having a stop surface configured to contact a rear wall of the channel when the strap is disposed within the channel and the pawl teeth engage the plurality of serrations in the strap.

17. The apparatus of claim 16, wherein the hinged connection defines a hinge axis relative to the head for the pawl to pivot about, and wherein the pivot member has a length that extends generally parallel to the hinge axis.

18. The apparatus of claim 16, further comprising, an open cavity defined in the pawl, and that extends into the pawl, from the notch, and in a direction of the top side of the pawl.

19. The apparatus of claim 16, wherein the pawl further comprises:

a release feature that extends from the top side of the pawl spaced apart from the front side, the second side, and the first side of the pawl.

20. The apparatus of claim 19, wherein the release feature is generally U-shaped.

* * * * *